US005898448A

United States Patent [19]

Ishikawa

[11] Patent Number: 5,898,448

[45] **Date of Patent: *Apr. 27, 1999**

[54] INK EJECTING DEVICE HAVING INK CHAMBERS OF DIFFERING SHAPES

[75] Inventor: Hiroyuki Ishikawa, Nisshin, Japan

[73] Assignee: Brother Kogyo Kabushiki Kaisha, Nagoya, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/530,427

[22] Filed: Sep. 19, 1995

[30] Foreign Application Priority Data

Feb. 17, 1995 [JP] Japan ..... 7-029080
Jul. 11, 1995 [JP] Japan ..... 7-175054

[51] Int. Cl.[6] ..... B41J 2/045
[52] U.S. Cl. ..... 347/69; 347/43
[58] Field of Search ..... 347/43, 69, 71, 347/100

[56] References Cited

U.S. PATENT DOCUMENTS 3,946,398 3/1976 Kyser et al. .
4,380,771 4/1983 Takatori .
4,723,129 2/1988 Endo et al. .
4,879,568 11/1989 Bartky et al. .
4,887,100 12/1989 Michaelis et al. .
5,016,028 5/1991 Temple .
5,274,400 12/1993 Johnson et al. ..... 346/140 R
5,410,341 4/1995 Sugahara et al. ..... 347/69
5,510,822 4/1996 Vincent et al. ..... 347/102
5,581,286 12/1996 Hayes et al. ..... 347/71

FOREIGN PATENT DOCUMENTS 5-261941 10/1993 Japan .
6-155766 6/1994 Japan .

*Primary Examiner*—Safet Metjahic
*Assistant Examiner*—Michael Dalakis
*Attorney, Agent, or Firm*—Oliff & Berridge, PLC

[57] ABSTRACT

The effective length of an ink chamber extends from a front end of a manifold to a nozzle plate. Accordingly, the lengths of the manifolds formed in one or more cover plates are different, based on the different types of ink ejected from each ink chamber to change the lengths of the ink chambers. The effective lengths of the ink chambers for differently colored inks, such as cyan, black, yellow and magenta inks, are different. In particular, the effective lengths of the ink chambers in the yellow, magenta, cyan and black ink ejecting devices are different according to the different viscosities of the yellow, magenta, cyan and black inks, so that the volumes of ink droplets ejected from the ink ejecting devices are substantially equal to each other. As a result, the dot diameters of the different types of ink on a sheet of paper are substantially equal to each other, allowing beautiful color images to be formed.

32 Claims, 8 Drawing Sheets

INK EJECTING DEVICE HAVING INK CHAMBERS OF DIFFERING SHAPES

BACKGROUND OF THE INVENTION

1. Field of the Invention

This invention relates to an ink ejecting device for recording an image which is designed to eject at least two types of ink, such as differently colored inks. In particular, this invention is directed to ensuring a constant drop volume or a constant dot size for drops or dots of the different types of ink.

2. Description of the Related Art

Traditional impact recording devices are now being replaced by non-impact type recording devices, and the market for non-impact type recording devices is expanding. One type of conventional non-impact type recording device, an ink ejecting recording device, has the simplest operating principles and is easily able to produce multi-scale and color images. Of the known types of ink ejecting recording devices, the drop-on-demand type ink ejecting recording device, which is capable of ejecting ink droplets only when required to form a dot of the image, has rapidly become very popular due to its good ejecting efficiency and its low running cost, among other beneficial features.

Known examples of such drop-on-demand type ink ejecting recording devices include a Kyser-type device disclosed in U.S. Pat. No. 3,946,398, a thermal ejecting type disclosed in U.S. Pat. No. 4,723,129, and a shear-mode type disclosed in U.S. Pat. Nos. 4,879,568, 4,887,100, and 5,016,028.

In forming an image by using any of these known types of ink ejecting devices, the volume of the ink droplets to be ejected changes as a shape and/or a size of the ink chambers change, as a shape and/or a size of the nozzles changes, as the physical properties of the ink changes, and/or as a magnitude and/or a pulse width of a driving voltage changes. Other factors can also affect the ink droplet volume. In forming a monochromatic image, the shape and the size of the ink chambers, the shape and/or the size of the nozzles, and the magnitude and the pulse width of the driving voltage are all strictly controlled across the array of nozzles so that there is no, or at most a minimum, variation in the volume of the ink droplets ejected from the array of nozzles. Accordingly, the diameters of the image dots formed by the ink droplets on a sheet of paper are essentially uniform, and a beautiful image is formed.

However, when forming a color image, a plurality of differently colored inks are used, each of which includes different components from the others. It is therefore difficult to provide differently colored inks having constant physical properties.

The volume of an ejected ink droplet is a function of the product of the velocity in an ejecting direction of a meniscus passing through a nozzle and the time required for the meniscus to pass through the nozzle in the ejecting direction. Accordingly, if a fixed driving voltage is applied to eject different ones of the inks, where each of the differently colored inks has different physical properties, such as different viscosities, the viscous resistance of each of the inks to flowing through the corresponding ink chamber is different, because of the different viscosities. This causes a difference in the velocity of the meniscus passing through the corresponding nozzle for each of the differently colored inks, resulting in the volume of the ink droplet for each of the differently colored inks being different.

To solve this problem, Japanese Unexamined Patent No. Publication No. 5-261941 discloses a method of adjusting the dot diameters by changing the magnitude of the driving voltage. In contrast, to solve this problem, Japanese Unexamined Patent No. Publication No. 6-155766 discloses a method of adjusting the dot diameters by changing the pulse width of the driving voltage. The result of each of these proposed solutions is to make the volume of the ink droplets for each of the differently colored inks to be equal to each other. However, these methods require either a plurality of power supplies or a complicated driving circuit, increasing the cost of the non-impact type recording device.

U.S. Pat. No. 4,380,771 discloses a method for making the ejection velocity of the ink droplets of the differently colored inks constant, by changing the magnitude of the driving voltage according to the different lengths of the ink chambers in an ink ejecting print head, wherein the lengths of the ink chambers are different according to which one of the differently colored inks is used in each ink chamber. However, in this method, a plurality of power supplies are also required to change the magnitude of the driving voltage. Thus, this method also requires a complicated driving circuit, increasing the cost of the non-impact recording device.

Furthermore, even if the volume of the ink droplets for each of the differently colored inks are made equal to each other, a difference in the surface tension of each of the differently colored inks causes a difference in the dot diameter of the ink dots formed on the paper for each of the differently colored inks. As a result, a beautiful color image cannot be created.

SUMMARY OF THE INVENTION

This invention therefore provides an ink ejecting device which is capable of forming a beautiful color image while using a uniform driving voltage and/or a simple driving circuit.

According to this invention, the ink ejecting device for ejecting a plurality of different types of ink to form an image comprises a plurality of ink chambers, each filled with a different one of the plurality of different types of ink, and an actuator member which forms the side surfaces of each of the ink chambers and changes a volume of each ink chamber; wherein each of the ink chambers is differently shaped according to the type of ink used in that ink chamber.

In the ink ejecting device according to this invention, the shapes of the ink chambers are different from each other according to the physical properties of the different types of ink. Accordingly, a one-way propagation time of a pressure wave acting on the ink contained in the ink chamber, due to a change in volume of the ink chamber created by the corresponding actuator members, is different according to the different types of ink. Thus, ink droplets of a suitable volume are ejected for each different type of ink. As a result, the dot diameters for each of the different types of ink on the paper are substantially equal to each other.

These and other features and advantages of this invention are described in or apparent from the following detailed description of the preferred embodiments.

BRIEF DESCRIPTION OF THE DRAWINGS

A preferred embodiment of this invention will be described in detail, with reference to the following figures, wherein.

DETAILED DESCRIPTION OF PREFERRED EMBODIMENTS

Figure 1:
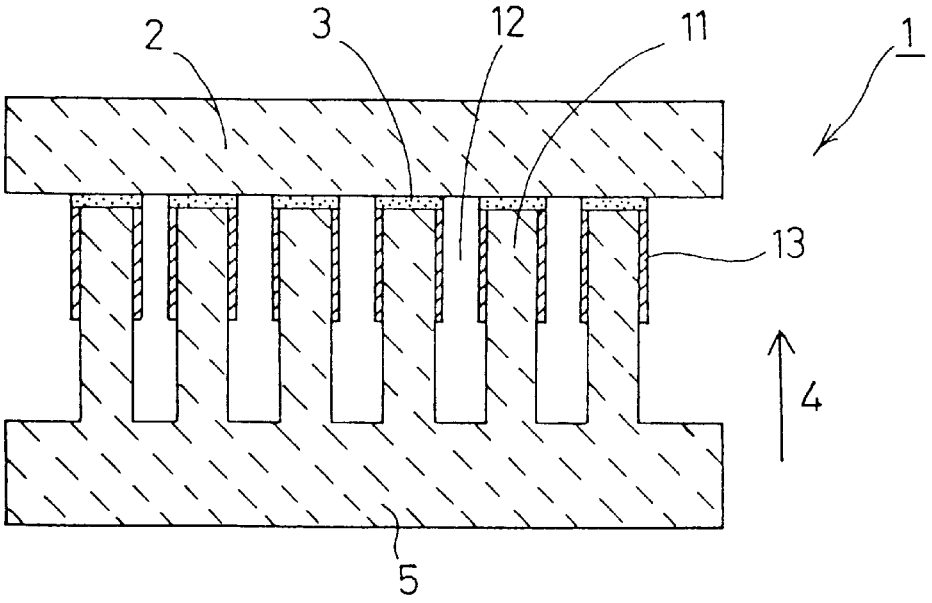
FIG. 1 is a cross-sectional view of a preferred embodiment of the ink ejecting device of this invention.

FIG. 1 shows a cross-sectional view across the length of the ink chambers 12 of an ink ejecting device 1. The ink ejecting device 1 includes a piezoelectric ceramic plate 5 having a plurality of grooves 15 cut into the ceramic plate 5, leaving a plurality of side walls 11 separating the grooves 15. The side walls 11 are polarized in the direction of the arrow 4. The ink ejecting device 1 also includes a cover plate 2 formed of, for example, a ceramic material or a resin material and a bonding layer 3 formed of an epoxy adhesive or the like for bonding together the piezoelectric ceramic plate 5 and the cover plate 2.

Thus, the grooves 15, when capped by the cover plate 2, form a plurality of ink chambers 12 which are laterally spaced from each other. Each ink chamber 12 has a rectangular cross section and is elongated in the direction extending into the sheet of FIG. 1. Each side wall 11 extends almost over the length of each ink chamber 12. Metal electrodes 13 for applying a driving voltage are formed an upper half portion of both side surfaces of each side wall 11. The metal electrodes 13 extend from a top portion of each side wall 11 near the bonding layer 3 to a central portion of each side wall 11. Each of the ink chambers 12 is filled with ink.

Figure 2:
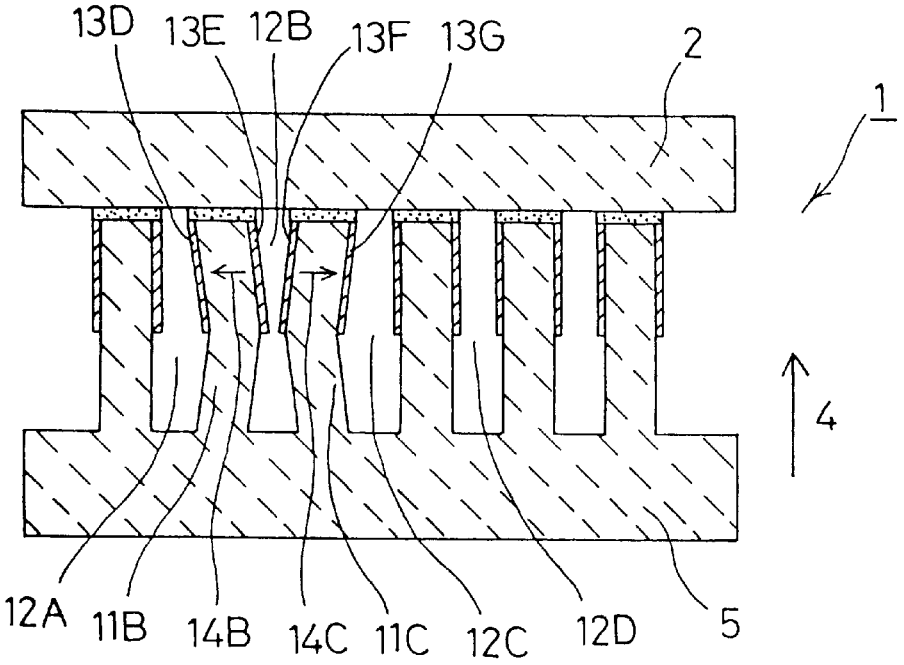
FIG. 2 is a cross-sectional view illustrating one example of the operation of the first preferred embodiment of the ink ejecting device of this invention.

The operation of the ink ejecting device 1 is shown in FIG. 2. When one of the ink chambers 12, for example, an ink chamber 12B, of the ink ejecting device 1 is selected in accordance with supplied print data, a positive driving voltage is applied to the metal electrodes 13E and 13F, while the metal electrodes 13D and 13G are grounded. Accordingly, the side wall 11B undergoes a driving electric field having a direction indicated by arrow 14B. Simultaneously, the side wall 11C undergoes a driving electric field having a direction indicated by arrow 14C. The directions 14B and 14C of the driving electric fields are perpendicular to the polarization direction 4 of the piezoelectric ceramic plate 5.

Figure 3:
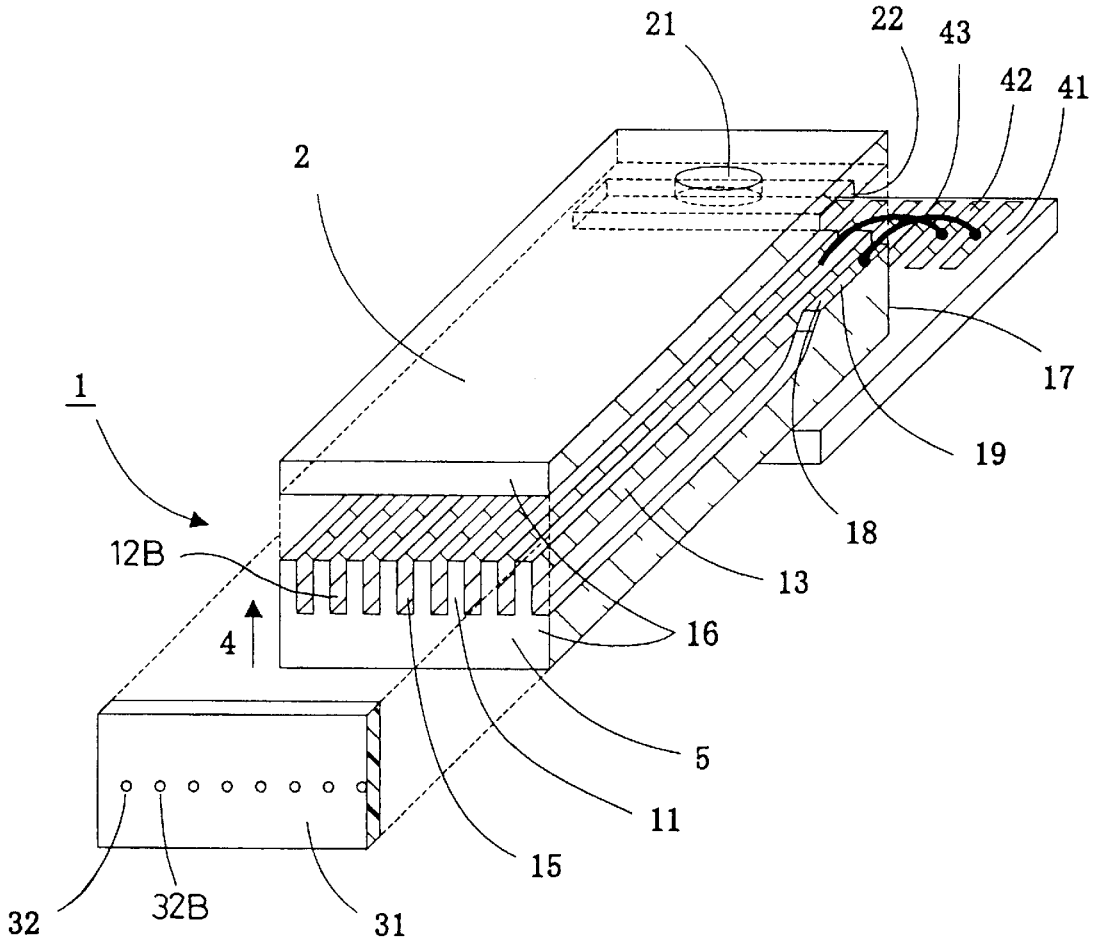
FIG. 3 is a perspective view of the first preferred embodiment of the ink ejecting device of this invention.

Thus, the side walls 11B and 11C are rapidly deformed toward an inside of the ink chamber 12B by a piezoelectric shear thickness effect. This deformation reduces the volume of the ink chamber 12B and thus rapidly increases the ink pressure in the ink chamber 12B. As a result, a pressure wave is generated in the ink chamber 12B to eject an ink droplet through a corresponding nozzle 32B, as shown in FIG. 3, which is connected to the ink chamber 12B.

When the driving voltage is removed from the metal electrodes 13E and 13F, the side walls 11B and 11C return to their original pre-deformation positions, as shown in FIG. 1. Accordingly, the ink pressure in the ink chamber 12B decreases, allowing the supply of ink to flow through a manifold 22 from an ink supply hole 21 of the cover plate 2, as shown in FIG. 3, into the ink chamber 12B.

Figure 4:
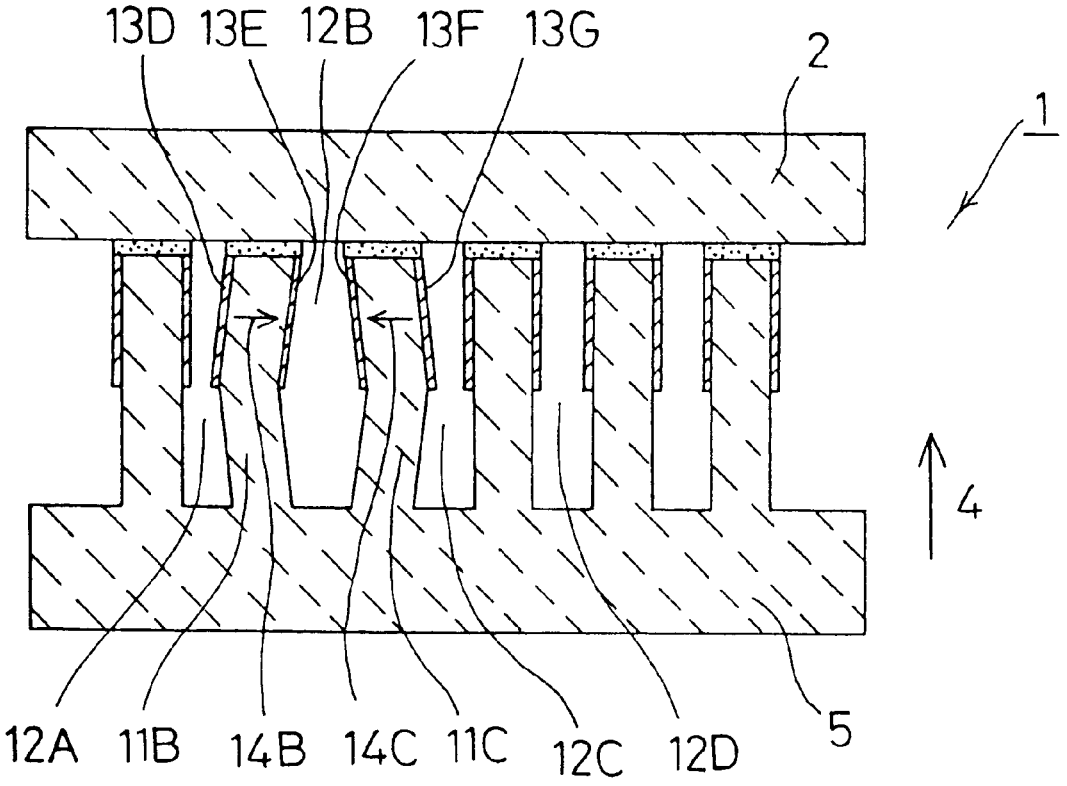
FIG. 4 is a cross-sectional view illustrating a second example of the operation of the first preferred embodiment of the ink ejecting device of this inventions.

It should be appreciated that the ink ejecting device 1 can also be operated using another manner of operation. For example, the driving voltage can be first applied in a direction which increases the volume of the ink chamber 12B, as shown in FIG. 4, such that additional ink flows into the ink chamber 12B. The driving voltage is then removed, so that the side walls 11B and 11C return to their original pre-deformation positions to eject a droplet of the ink. Alternatively, a driving voltage pattern called a canceling pulse can be applied after a suitable period of time, to attenuate the pressure wave in the ink chamber 12B.

In the ink ejecting device 1, ink droplets cannot be simultaneously ejected from any two adjacent nozzles 32 connected to two correspondingly adjacent ink chambers 12. Accordingly, the ink chambers 12 and the nozzles 32 are divided into a plurality of groups to successively eject ink droplets from each group. For example, ink droplets are first ejected from the nozzles 32 connected to the ink chambers 12A and 12C as the odd ink chambers (counted from the left end). Thereafter, ink droplets are ejected from the nozzles 32 connected to the ink chambers 12B and 12D as the even ink chambers (counted from the left end). Then, ink droplets are next ejected from the nozzles 32 corresponding to the odd ink chambers.

A method for manufacturing the ink ejecting device 1 is shown in FIG. 3. The piezoelectric ceramic plate 5 is preliminarily polarized in the direction of arrow 4 is and machined by grinding or the like using a thin disk-shaped diamond blade to form the parallel grooves 15 for the ink chambers 12. The depth of each of the parallel grooves 15 is the same over almost the whole of the piezoelectric ceramic plate 5. Specifically, the depth of one end portion of each of the grooves 15 is gradually reduced near an end surface 17 of the piezoelectric ceramic plate 5. Thus, the grooves 15 near the end surface 17 become parallel shallow grooves 18.

The metal electrodes 13 are formed by sputtering or the like on the inner surfaces of the grooves 15. Additional metal electrodes 19 are also formed by sputtering or the like on the shallow grooves 18. Specifically, the metal electrodes 13 are formed on both upper half portions of the inner surfaces of each groove 15, while the metal electrodes 19 are formed on both side surfaces and the bottom surface of each shallow groove 18. The metal electrodes 13 formed on the inner surface of each groove 15 are electrically connected to the metal electrodes 19 in each shallow groove 18. The cover plate 2, which is formed, for example, of a ceramic material or a resin material, is machined by grinding, cutting, etc. to form the ink supply hole 21 and the manifold 22.

Then, the piezoelectric ceramic plate 5 and the cover plate 2 are bonded together by the bonding layer 3, such as an epoxy adhesive, so that, as shown in FIGS. 1, 2 and 4, the upper surface of the piezoelectric ceramic plate 5 and the lower surface of the cover plate 2 are bonded through the bonding layer 3 to define the ink chambers 12. Then, a nozzle plate 31 having the plurality of nozzles 32, which are arranged at positions corresponding to the positions of the ink chambers 12, is bonded to an end surface 16 of the assembly of the piezoelectric ceramic plate 5 and the cover plate 2. A board 41, on which a plurality of conductor patterns 42 are formed at positions corresponding to the positions of the ink chambers 12, is bonded by an epoxy adhesive or the like to the lower surface of the piezoelectric ceramic plate 5, as shown in FIG. 3.

Then, the metal electrode 19 formed on the bottom surface of each shallow groove 18 is connected to a corresponding one of the conductor patterns 42 by a lead wire 43. Usually, wire bonding is used to connect the conductor patterns 42 and metal electrodes 19 to the lead wire 43. The lead wire 43 usually has a very small diameter and minimal mechanical strength. Therefore, in order to prevent adjacent lead wires 43 from contacting each other and/or breaking, and to prevent corrosion of the lead wires 43 due to moisture or dust in the air, each lead wire 43 is generally covered with a protective film (not shown), using for example, a resin such as an epoxy resin, or potting. The protective film is hardened by heat.

Figure 5:
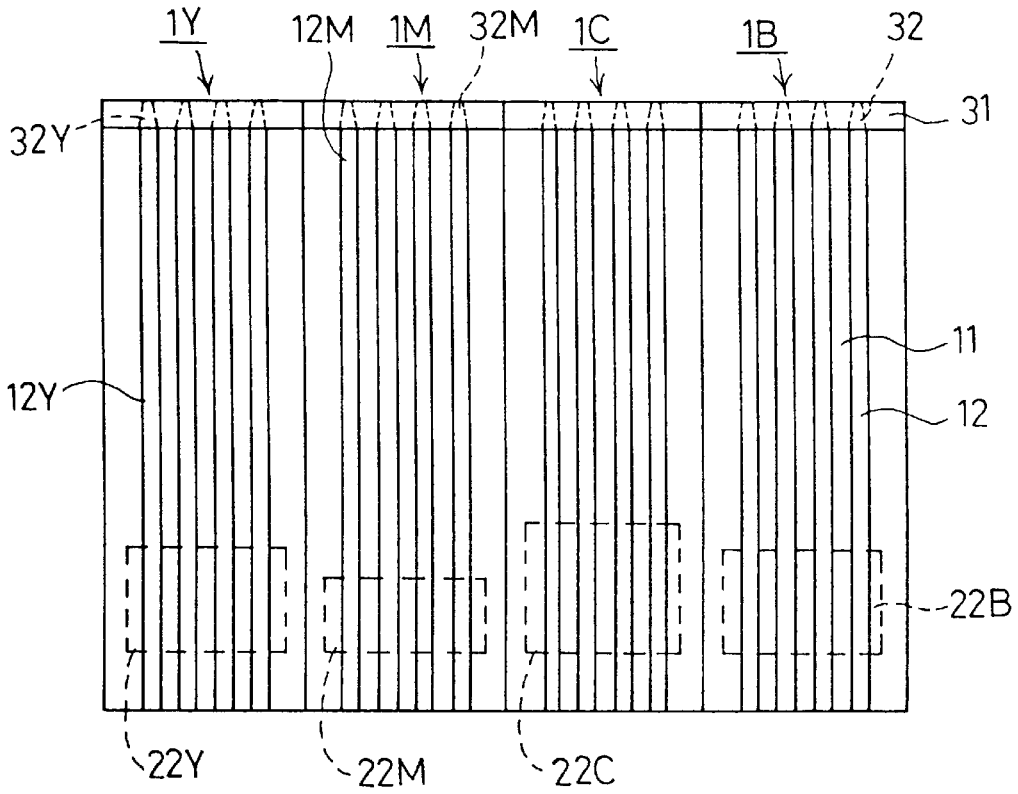
FIG. 5 is a top plan view of the first preferred embodiment of the ink ejecting device of this invention, illustrating the different lengths of the ink chambers for each of the differently colored inks.
Figure 6:
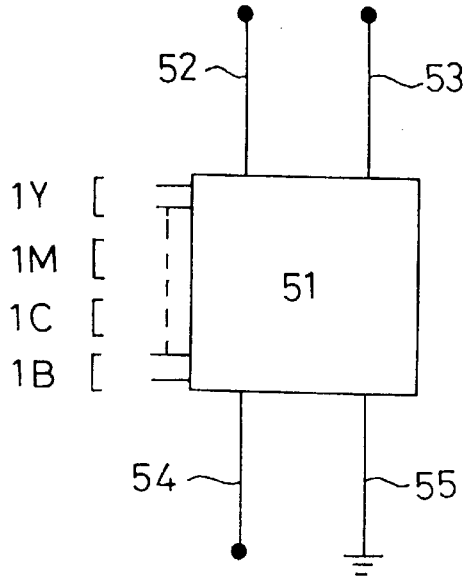
FIG. 6 is a block diagram of a control device for the first preferred embodiment of the ink ejecting device of this invention.

Thereafter, a plurality of the ink ejecting devices 1 are similarly fabricated. For example, four ink ejecting devices 1Y, 1M, 1C, and 1B for yellow (Y), magenta (M), cyan (C), and black (B) inks, as shown in FIG. 5, are prepared. Then, as shown in FIG. 6, the conductor patterns 42 of each of the ink ejecting devices 1Y, 1M, 1C, and 1B are connected to an LSI chip 51. A clock line 52, a data line 53, a voltage line 54, and a ground line 55 are also connected to the LSI chip 51, as shown in FIG. 6.

The LSI chip 51 determines which ones of the ink ejecting devices 1Y to 1B are selected and which ones of the nozzles 32 of the thus selected ink ejecting devices are selected to eject ink droplets, based on print data appearing on the data line 53 and continuous clock pulses supplied from the clock line 52. Then, the LSI chip 51 applies a driving voltage V (whose magnitude and pulse width are constant) on the voltage line 54 to the conductor patterns 42 corresponding to the selected ink chambers 12 of the selected ink ejecting devices 1Y–1B. The LSI chip 51 also connects the ground line 55 to the conductor patterns 42 corresponding to the remaining (i.e. non-selected ones of the ink chambers 12.

Accordingly, the side walls 11 forming the driven ink chambers 12 are deformed, as outlined above, to eject ink droplets of the selected colors. Similarly, ink droplets of different colors are ejected from the nozzles 32 of the other ink ejecting devices 1Y–1B. Thus, a color image can be formed.

Figure 7:
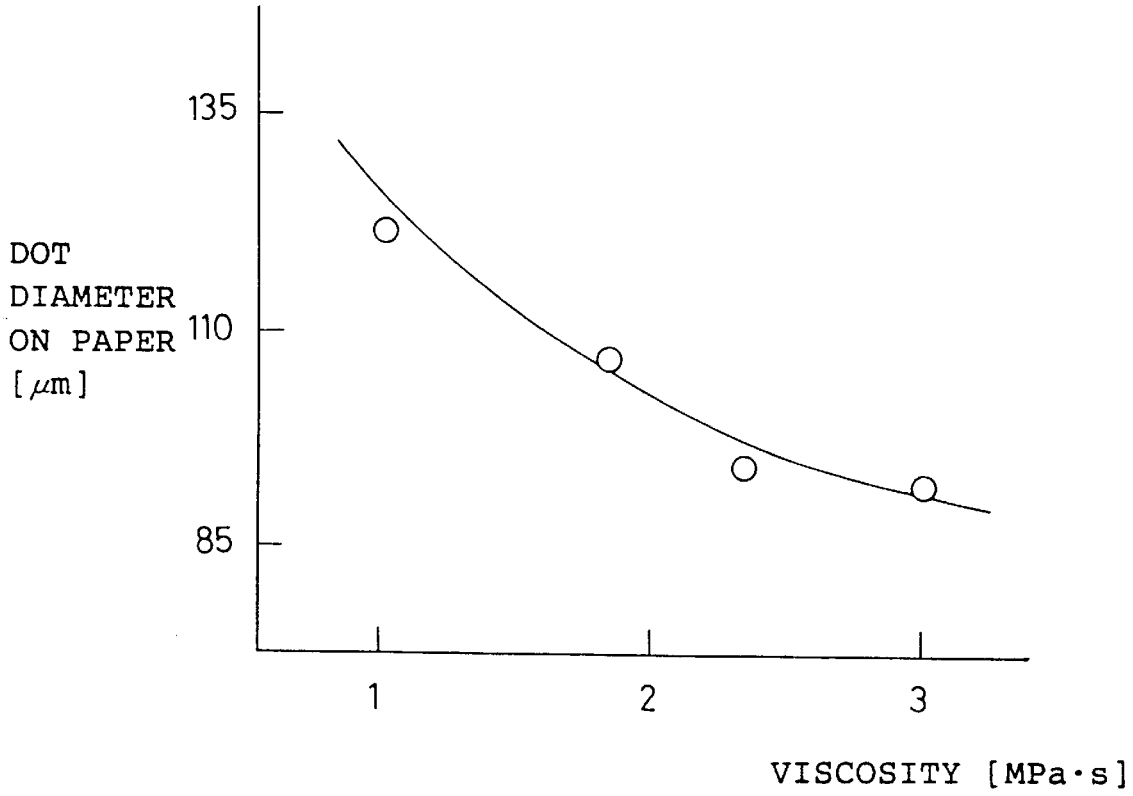
FIG. 7 is a graph showing the relationship between the viscosity of the ink and the dot diameter of the ink dot formed on the paper.

All the inks have different viscosities. In this first preferred embodiment, the viscosities of the yellow, magenta, cyan and black inks are 1.9 mPa·s (milliPascal·second), 2.1 mPa·s, 1.6 mPa·s, and 1.8 mPa·s, respectively. In general, a change in viscosity of the ink causes a corresponding change in the viscous resistance between the ink and each of the ink chamber 12 and the nozzle 32. Accordingly, the velocity of the meniscus passing through the nozzle and the time required for the meniscus to pass through the nozzle also change. As a result, the volume of the ejected ink droplets changes, causing a corresponding change in the dot diameter of the ejected ink droplets when printed on a high-quality paper. This relationship is shown in FIG. 7.

Accordingly, since the viscosity varies with the different types of ink, the dot diameter on the paper varies with the different types of ink. When forming a color image, a plurality of the different types of ink are arrayed or overlapped in a portion of the color image to adjust a color tone of that portion. Accordingly, variations in the dot diameter make it impossible to obtain a desired color tone.

In this first preferred embodiment, the length of the ink chambers 12 of each of the ink ejecting devices 1Y, 1M, 1C and 1B, as shown in FIG. 5, are different from each other. The different ink chamber lengths are based on which one of the different types of ink is to be ejected from each device. This corrects for the variations in the dot diameter due to the different viscosities of each of the differently colored inks. If the other physical properties of the different types of inks are the same, the length of the ink chambers 12 of each of the ink ejecting devices 1Y, 1M, 1C and 1B is related to the resulting dot diameter of the ink droplets on the paper, by the relationship shown in FIG. 8.

Figure 8:
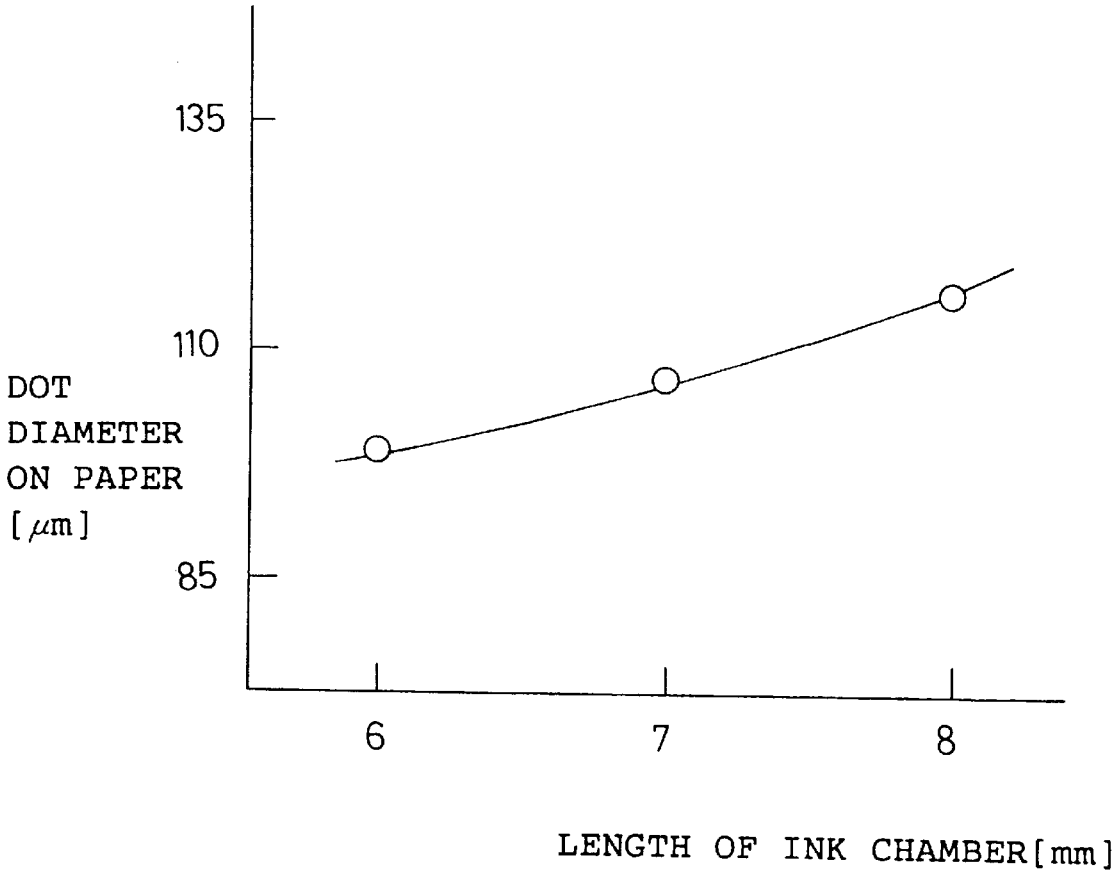
FIG. 8 is a graph showing the relationship between the length of an ink chamber and the dot diameter of the ink dot formed on the paper.

As apparent from FIG. 8, the longer the ink chamber 12, the larger the volume of ink droplets ejected and therefore, the larger the dot diameter on the paper. Specifically, when the length of the ink chamber 12 increases, the time required for the pressure wave generated by changing the volume of the ink chamber 12 to propagate one way along the ink chamber 12 increases. As a result, the time required for the meniscus to pass through the nozzle 32 in the ejecting direction increases, which determines the volume of ink droplets.

In general, it is difficult to change the length of the ink chambers 12 by machining. The effective length of the ink chamber 12 extends from where the edge of the manifold 22 contacts the ink chamber 12 to the nozzle plate 3. Accordingly, in this first preferred embodiment, the lengths of the manifolds 22 (22Y, 22M, 22C, and 22B) formed in the cover plates 2 are made different from each other according to the different types of ink, yellow, magenta, cyan and black, as shown in FIG. 5. This changes the effective length of the ink chambers 12Y, 12M, 12C, 12B, as shown in FIG. 5, according to the different types of ink. The lengths of the ink chambers 12Y, 12M, 12C and 12B of the ink ejecting devices 1Y, 1M, 1C, and 1B are different.

In particular, the length of the magenta ink chambers 12M of the ink ejecting device 1M for ejecting the magenta ink, which has the highest viscosity, is the longest of the four ink ejecting devices. The length of the yellow ink chambers 12Y of the ink ejecting device 1Y for ejecting the yellow ink, which has the second highest viscosity, is the second longest. The length of the black ink chambers 12B of the ink ejecting device 1B for ejecting the black ink, which has the third highest viscosity, is the third longest. Finally, the length of the cyan ink chambers 12C of the ink ejecting device 1C for ejecting the cyan ink, which has the lowest viscosity, is the shortest of the four ink ejecting devices.

This therefore makes the volumes of ink droplets ejected from all the ink ejecting devices 1Y–1B constant. As a result, the dot diameters of each of the differently colored ink dots on the paper are effectively constant at a diameter of, for example, 100 $\mu$m. Although the effective lengths of the ink chambers 12 in this first preferred embodiment are different, due to changing the lengths of the manifolds 22, the overall lengths of the ink chambers 12 may, of course, also be different.

The operation of this first preferred embodiment will be described in more detail by comparing the ink ejecting device 1Y and the ink ejecting device 1M. The nozzles 32Y connecting to the ink chambers 12Y of the ink ejecting device 1Y, and the nozzles 32M connect to the ink chambers 12M of the ink ejecting device 1M, as shown in FIG. 5.

When the volume of the ink chambers 12Y and 12M of the ink ejecting devices 1Y and 1M are simultaneously reduced, the pressure in the ink chambers 12Y and 12M increases to generate pressure waves in the ink chambers 12Y and 12M. At the same time, the menisci project from the nozzles 32Y and 32M in an ejecting direction.

The pressure waves thus generated propagate in one way in each of the ink chambers 12Y and 12M. When each pressure wave reaches a front end of the corresponding ink chamber 12, the pressure wave is reflected from the front end and is inverted in sign to propagate in the reverse direction of the corresponding ink chamber 12. Since the length of each ink chamber 12Y is smaller than the length of each ink chamber 12M, the one-way propagation time of the pressure waves in the ink chambers 12Y is shorter than the one-way propagation in each ink chamber 12M.

Accordingly, the sign of the pressure wave near each nozzle 32M is first inverted into a negative sign to retract the meniscus toward each ink chamber 12Y. Accordingly, a rear portion of the ink projecting from each nozzle 32Y is cut away from the menisci to form the ejected ink droplets. Then, the sign of the pressure waves near each nozzle 32M is inverted into a negative sign to retract the menisci toward each ink chamber 12M. Accordingly, a rear portion of the ink projecting from each nozzle 32M is cut away from the menisci to form the ejected ink droplets.

In this manner, the time required for the menisci to pass through the nozzles 32M of the ink ejecting device 1M, which has relatively longer ink chambers 12M, is longer than the time required for the menisci to pass through the nozzles 32Y of the ink ejecting device 1Y. Additionally, since the viscosity of the yellow ink is smaller than the viscosity of the magenta ink, the velocity of the menisci passing through the nozzles 32Y in the ejecting direction of the ink ejecting device 1Y is higher than the velocity of the menisci passing through the nozzles 32M of the ink ejecting device 1M.

In general, the volume of the ejected ink droplets is determined by the product of the velocity of the menisci passing through the nozzles 32 in the ejecting direction and the time required for the menisci to pass through each nozzle 32 in the ejecting direction. Therefore, the volume of ink droplets ejected from the ink ejecting device 1M is substantially equal to the volume of the ink droplets ejected from the ink ejecting device 1Y.

As described above, in the ink ejecting devices 1M, 1M, 1C, and 1B of this first preferred embodiment, the lengths of the ink chambers 12 in each ink ejecting device are different from the other ink ejecting devices, based on the different viscosities of the inks to be ejected. Thus, the volumes of ink droplets ejected from each of the ink ejecting devices are substantially equal to each other. Accordingly, the dot diameters of the dots of each of the differently colored inks on the paper are substantially equal to each other, thus allowing beautiful color images to be created.

Further, unlike the prior art methods where the magnitude or the pulse width of the driving voltage is changed based on the type of ink to be ejected, this first preferred embodiment uses a fixed driving voltage V for all of the differently colored inks. Therefore, the configuration of the driving circuit is simplified and the cost of the ink ejecting recording device does not increase.

Additionally, rather than adjusting the lengths of the ink chambers 12 to adjust the dot diameter on the paper, the shapes of the ink chambers 12, such as the height or width of the ink chambers 12, or, in general, the cross-sectional area of the ink chambers 12, may be adjusted to adjust the dot diameter on the paper. Further, although the dot diameter on the paper is adjusted based on the viscosities of the inks, as one of the physical properties of the inks, in this first preferred embodiment, the shapes of the ink chambers 12 may be adjusted based on the surface tensions of the inks or any other physical property of the inks.

Figure 9:
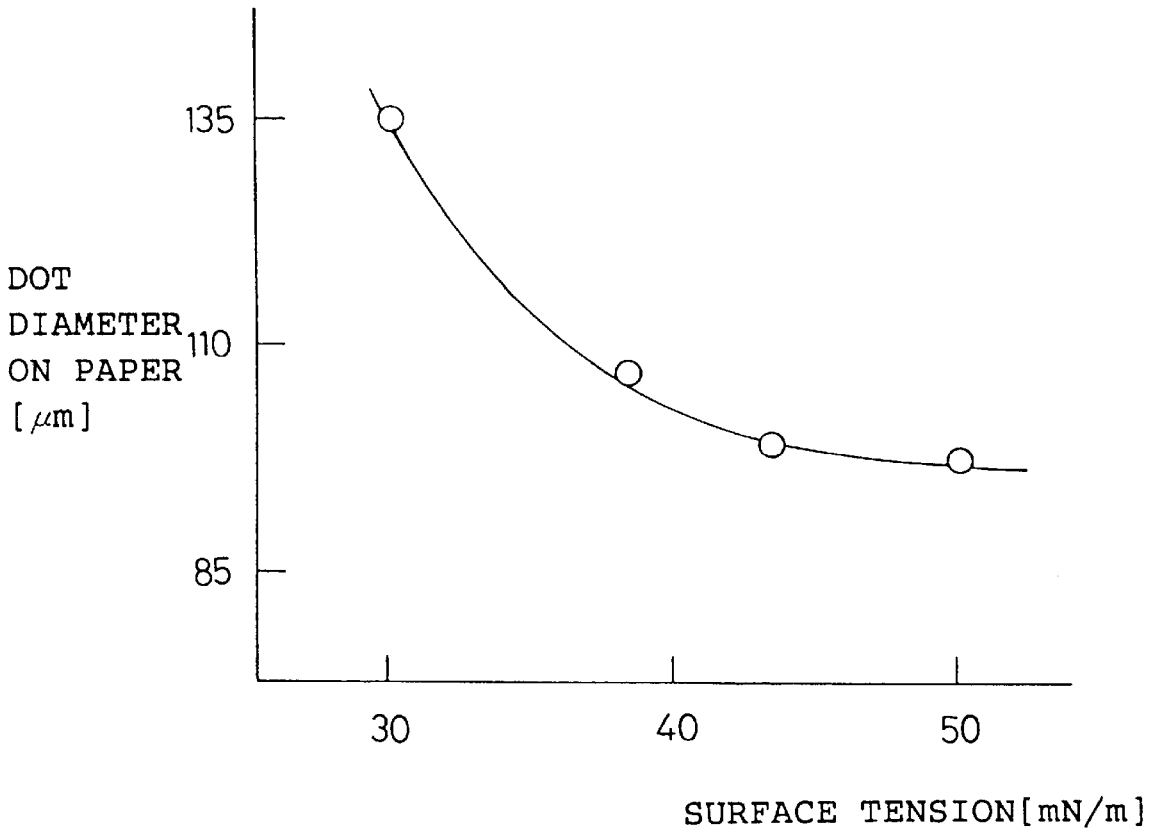
FIG. 9 is a graph showing the relationship between the surface tension of the ink and the dot diameter of the ink dot formed on the paper.

Thus, in a second preferred embodiment of the ink ejecting device 2 of this invention, the surface tensions of the different types of ink, which are different from each other, are used to determine the shape and/or size of the ink channels 12. In particular, a change in surface tension of the ink does not cause a change in the volume of the ejected ink droplets. Rather, the change in the surface tension causes a change in the spread or area of an ink dot formed on a high-quality paper. That is, the dot diameter on the paper decreases as the surface tension of the ink increases, as shown in FIG. 9. Accordingly, the dot diameters on the paper are different for each of the different types of ink. In this second preferred embodiment, the surface tensions of the cyan, black, yellow, and magenta inks are 32 mN/m (milliNewtons per meter), 36 mN/m, 38 mN/m, and 42 mN/m, respectively.

In this second preferred embodiment, the lengths of the ink chambers 12 of the yellow, magenta, cyan and black ink ejecting devices 1Y, 1M, 1C, and 1B are arranged so that the length of the ink chambers 12C of the cyan ink ejecting device 1C are the shortest, those of the black ink ejecting device 1B are longer, those of the yellow ink ejecting device 1Y are longer still, and the ink chambers 12M of the magenta ink ejecting device 1M are the longest.

In other words, the lengths of the ink chambers 12M of the ink ejecting device 1M for ejecting the magenta ink M having the highest surface tension are the longest of the four ink ejecting devices. The lengths of the ink chambers 12Y of the ink ejecting device 1Y for ejecting the yellow ink Y having the second highest surface tension are the second longest. The lengths of the ink chambers 12B of the ink ejecting device 1B for ejecting the black ink B having the third highest surface tension are the third longest and the lengths of the ink chamber 12C of the ink ejecting device 1C for ejecting the cyan ink C having the lowest surface tension are the shortest of the four ink ejecting devices.

Accordingly, the volumes of ink droplets ejected from all the ink ejecting devices are different, so that the volume of the cyan ink droplets is the smallest, the volume of the black ink droplets is larger, the volume of the yellow ink droplets is larger still, and the volume of the magenta ink droplets is the largest. As a result, the dot diameter of the cyan, black, yellow and magenta ink dots on the paper is substantially constant.

In the ink ejecting devices 1Y, 1M, 1C, and 1B according to this second preferred embodiment, the lengths of the ink chambers 12 are different according to the different surface tensions of the inks, so that the volumes of the ink droplets ejected from the ink ejecting devices are different according to the different surface tensions of the different types of ink. However, the dot diameters of dots of each of the different inks on the paper are substantially equal to each other. Thus beautiful color images can be formed. Furthermore, unlike the prior art methods, where the magnitude or the pulse width of the driving voltage is changed for each of the different types of ink, this second preferred embodiment uses a fixed driving voltage V for all of the different types of inks. Therefore, the driving circuit is simplified and the cost of the ink ejecting recording devices does not increase.

In the ink ejecting devices of the first and second preferred embodiments, the shapes of the ink chambers are different from each other based on the different types of inks, the different inks having different physical properties. Accordingly, the one-way propagation times of pressure waves acting on the inks contained in the ink chambers 12 due to a change in volume of the ink chambers 12 are different based on the viscosity or other physical properties of the different types of inks to eject ink droplets having suitable volumes. As a result, the dot diameters on the paper of the different types of ink are substantially equal to each other. Thus, beautiful color images can be recorded.

Furthermore, all of the ink chambers 12 are driven at a uniform driving voltage, rather than by a driving voltage which changes in magnitude and pulse width according to the different types of ink, as in the prior art. Accordingly, the driving circuit is simpler than that in the prior art, preventing the cost of the ink ejecting recording device from increasing.

In the first and second preferred embodiments, all of each side wall 11 is formed of piezoelectric ceramics material. The metal electrodes 13 are formed on the upper half portion of each side wall 11. Thus, the ink droplets are ejected due to the piezoelectric shear thickness deformation of the upper half portion of each side wall 11.

Alternately, only the upper half portion or only the lower half portion of each side wall 11 is formed of piezoelectric ceramic material. The other half portion of each side wall 11 is formed of a non-piezoelectric material. In this case, the metal electrodes 13 are formed on the whole side surfaces of each side wall 11. Thus, the ink droplets are ejected due to the piezoelectric shear thickness deformation of the upper half portion or the lower half portion of each side wall 11.

In another alternate embodiment, the upper half portion and the lower half portion of each side wall 11 are individually formed of piezoelectric ceramic material having different polarization directions. The metal electrodes 13 are formed on the whole side surfaces of each side wall 11. Thus, the ink droplets are ejected due to the piezoelectric shear thickness deformation of both the upper half portion and the lower half portion of each side wall 11. In this case, the magnitude of a driving voltage can be reduced relative to that needed for the first and second preferred embodiments.

Furthermore, in yet another alternate embodiment, while adjacent ones of the ink chambers 12 are separated solely by one of the side walls 11 in the first and second preferred embodiments, dummy air chambers, which are not filled with ink, are formed between adjacent ones of the ink chambers 12. In this case, mutual interference due to ink ejection from adjacent ink chambers 12 is prevented.

Figure 10:
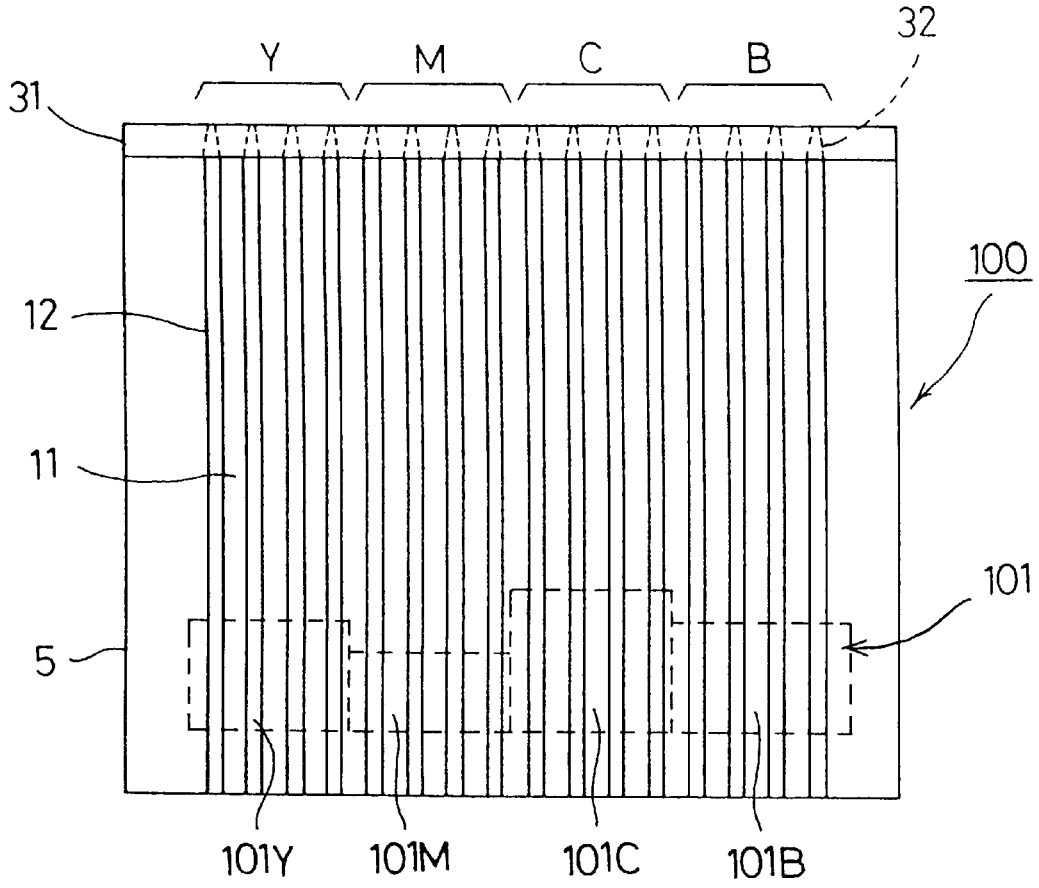
FIG. 10 is a top plan view of a second preferred embodiment of the ink ejecting device of this invention illustrating the difference lengths of the ink chambers.

Further, while four ink ejecting devices 1Y, 1M, 1C, and 1B are used in the first and second preferred embodiments, as shown in FIG. 5, to form a color image, a single ink ejecting device 100, as shown in FIG. 10, may be used, instead. In this single ink ejecting device 100, the ink chambers 12 are divided into four groups by a manifold 101 having four different ink supplying portions 101Y, 101M, 101C and 101B to allow ejecting of yellow, magenta, cyan, and black inks.

Furthermore, while the volume of each ink chamber 12 is changed by deforming the corresponding side walls 11 to generate a pressure wave in each ink chamber 12 to eject an ink droplet, other actuator members, such as a solenoid, may be used to change the volume of the ink chambers 12 to generate the pressure waves in the ink chambers and eject the ink droplets.

While this invention has been described in conjunction with the specific embodiments outline above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An ink ejecting device for ejecting a plurality of different types of ink to form an image, comprising:

an actuator member, a plurality of grooves and a plurality of side walls formed in the actuator member;

a cover plate attached to the actuator member over the plurality of grooves;

a nozzle plate having a plurality of nozzles and attached to a front of the actuator member and the cover plate;

a plurality of ink chambers defined by the grooves and the side walls of the actuator member, the cover plate and the nozzle plate, each of the ink chambers filled with one of the plurality of the different types of ink, wherein the side walls form side surfaces of each of the plurality of ink chambers and have piezoelectric portions extending over the length of each ink chamber, the side walls capable of changing a volume of each ink chamber, wherein the ink is ejected from each ink chamber by deformation of the piezoelectric portions; and an ink supply manifold supplying the plurality of different types of ink to the plurality of ink chambers;

wherein a length of each of the plurality of ink chambers is determined based on which of the plurality of the different types of ink are supplied to the ink chambers and a one-way propagation time of a pressure wave is changed due to a difference in the length of the ink chamber and thereby a volume of an ink droplet ejected from each ink chamber is adjusted, the pressure wave generated by changing the volume of each ink chamber.

2. The ink ejecting device according to claim 1, wherein the ink supply manifold comprises, for each of the plurality of different types of ink, one supply port connected to at least one of the plurality of ink chambers, wherein, for each of the ink chambers, the length of the ink chamber along a direction of flow of the ink is determined by a size of the supply port connected to the ink chamber.

3. The ink ejecting device according to claim 1, wherein, for each of the plurality of the different types of ink, a length of ink chambers supplied with one type of ink along a direction of flow of the ink is different than the lengths of ink chambers supplied with the other types of ink.

4. The ink ejecting device according to claim 3, wherein the ink supply manifold comprises, for each of the plurality of different types of ink, one supply port connected to at least one of the plurality of ink chambers, wherein, for each of the different types of ink, the length of ink chambers supplied with each type of ink along a direction of flow of the ink is determined by a size of the supply port connected to the ink chambers.

5. The ink ejecting device according to claim 1, wherein, for each of the ink chambers, a cross section of the ink chamber perpendicular to a direction of flow of said ink is determined based on which of the plurality of the different types of ink are supplied to that ink chamber.

6. The ink ejecting device according to claim 1, wherein, for each of the plurality of the different types of ink, a cross section of ink chambers supplied with one type of ink perpendicular to a direction of flow of the ink is different than the cross sections of ink chambers supplied with the other types of ink.

7. The ink ejecting device according to claim 1, wherein the side walls are deformed by piezoelectric shear thickness deformation of the piezoelectric portions to eject ink from each ink chamber.

8. The ink ejecting device according to claim 1, wherein, for each of the side walls, an electrode is provided on at least a portion of the side wall.

9. The ink ejecting device according to claim 8, wherein, for each of the side walls, a polarization direction of the piezoelectric portion is perpendicular to an electric field direction in the side wall.

10. The ink ejecting device according to claim 8, wherein a same voltage is applied to the electrodes of the side walls to eject the plurality of different types of ink.

11. The ink ejecting device according to claim 1, wherein at least one of a drop volume of an ejected droplet and a dot diameter of a dot on a recording sheet will be the same for each one of the plurality of different types of ink.

12. The ink ejecting device according to claim 1, wherein the actuator member comprises a single actuator member, the plurality of ink chambers of the single actuator member being divided into a plurality of ink chamber groups, each ink chamber group being supplied with a different one of the plurality of different types of ink, a shape of the ink chambers of each ink chamber group being different from the shapes of the ink chambers of the other ink chamber groups based on which of the plurality of the different types of ink are supplied to that ink chamber group.

13. The ink ejecting device according to claim 12, wherein, for each of the ink chamber groups, one of a length of the ink chambers along a direction of flow of the ink and a cross section of the ink chambers perpendicular to a direction of flow of the ink is different than that of the other ink chamber groups.

14. The ink ejecting device according to claim 1, wherein the actuator member comprises a plurality of actuator members, each actuator member being supplied with a different one of the plurality of different types of ink, a shape of the ink chambers of each actuator member being different from the shapes of the ink chambers of the other actuator members based on which of the plurality of the different types of ink are supplied to that actuator member.

15. The ink ejecting device according to claim 14, wherein, for each of the actuator members, one of a length of the ink chambers along a direction of flow of the ink and a cross section of the ink chambers perpendicular to a direction of flow of the ink is different than that of the ink chambers of the other actuator members.

16. The ink ejecting device according to claim 1, wherein a shape of each of the plurality of ink chambers is determined based on at least one of a viscosity and a surface tension of each of the plurality of the different types of ink supplied to the ink chambers.

17. The ink ejecting device according to claim 1, wherein the one-way propagation time of a pressure wave is a time period during which the pressure wave propagates between the ink supply manifold and the nozzle plate.

18. An ink ejecting device for ejecting a plurality of different types of ink to form an image, comprising:

a plurality of actuator members, each actuator member supplied with a different one of the plurality of different types of ink;

a plurality of grooves and a plurality of side walls formed in each one of the plurality of actuator members;

a cover plate attached to the plurality of actuator members over the plurality of grooves;

a nozzle plate having a plurality of nozzles and attached to a front of the plurality of actuator members and the cover plate;

a plurality of ink chambers defined by the grooves and the side walls of the plurality of actuator members, the cover plate and the nozzle plate, each of the ink chambers of one of the plurality of actuator members filled with a different one of the plurality of the different types of ink, wherein the side walls form side surfaces of each of the plurality of ink chambers and have piezoelectric portions extending over the length of each ink chamber, the side walls capable of changing a volume of each ink chamber, wherein the ink is ejected from each ink chamber by deformation of the piezoelectric portions; and an ink supply manifold supplying one of the plurality of different types of ink to the plurality of ink chambers of each of the plurality of actuators;

wherein a length of the plurality of ink chambers of each one of the plurality of actuator members is determined based on which of the plurality of the different types of ink are supplied to the actuator member and a one-way propagation time of a pressure wave is changed due to a difference in the length of the ink chamber and thereby a volume of an ink droplet ejected from each ink chamber is adjusted, the pressure wave generated by changing the volume of each ink chamber.

19. The ink ejecting device according to claim 18, wherein the ink supply manifold comprises, for each of the plurality of actuator members, a supply port connected to the plurality of ink chambers of the actuator member, wherein, for each of the actuator members, the length of the ink chamber along a direction of flow of the ink is determined by a size of the supply port connected to the ink chambers of that actuator member.

20. The ink ejecting device according to claim 18, wherein, for each of the plurality of actuator members, a cross section of the ink chambers perpendicular to a direction of flow of said ink is determined based on which of the plurality of the different types of ink are supplied to the actuator member.

21. The ink ejecting device according to claim 18, wherein the side walls are deformed by piezoelectric shear thickness deformation of the piezoelectric portions to eject ink from each ink chamber.

22. The ink ejecting device according to claim 18, wherein, for each of the side walls, an electrode is provided on at least a portion of the side wall.

23. The ink ejecting device according to claim 22, wherein, for each of the side walls, a polarization direction of the piezoelectric portion is perpendicular to an electric field direction in the side wall.

24. The ink ejecting device according to claim 22, wherein a same voltage is applied to the electrodes of the side walls to eject the plurality of different types of ink.

25. The ink ejecting device according to claim 18, wherein at least one of a drop volume of an ejected droplet and a dot diameter of a dot on a recording sheet will be the same for each one of the plurality of different types of ink.

26. The ink ejecting device according to claim 18, wherein a shape of each of the plurality of ink chambers is determined based on at least one of a viscosity and a surface tension of each of the plurality of the different types of ink supplied to the ink chambers.

27. The ink ejecting device according to claim 18, wherein the one-way propagation time of a pressure wave is a time period during which the pressure wave propagates between the ink supply manifold and the nozzle plate.

28. An ink ejecting device for ejecting a plurality of different types of ink to form an image, comprising:

an actuator member, a plurality of grooves and a plurality of side walls formed in the actuator member;

a cover plate attached to the actuator member over the plurality of grooves;

a nozzle plate having a plurality of nozzles and attached to a front of the actuator member and the cover plate;

a plurality of ink chambers defined by the grooves and the side walls of the actuator member, the cover plate and the nozzle plate, each of the ink chambers filled with one of the plurality of the different types of ink, wherein the side walls form side surfaces of each of the plurality of ink chambers and have piezoelectric portions extending over the length of each ink chamber, the side walls capable of changing a volume of each ink chamber, wherein the ink is ejected from each ink chamber by deformation of the piezoelectric portions; and an ink supply manifold supplying the plurality of different types of ink to the plurality of ink chambers;

a power supply circuit electrically connected to each of the plurality of ink chambers and supplying a same ink ejection voltage to each of the plurality of ink chambers;

wherein a length of each of the plurality of ink chambers is determined based on which of the plurality of the different types of ink are supplied to the ink chambers and a one-way propagation time of a pressure wave is changed due to a difference in the length of the ink chamber and thereby a volume of an ink droplet ejected from each ink chamber is adjusted, the pressure wave generated by changing the volume of each ink chamber.

29. The ink ejecting device according to claim 28, wherein at least one of a drop volume of an ejected droplet and a dot diameter of a dot on a recording sheet will be the same for each one of the plurality of different types of ink.

30. The ink ejecting device according to claim 29, wherein, for each of the side walls, an electrode is provided on at least a portion of the side wall and a polarization direction of the piezoelectric portion is perpendicular to an electric field direction in the side wall.

31. The ink ejecting device according to claim 28, wherein the one-way propagation time of a pressure wave is a time period during which the pressure wave propagates between the ink supply manifold and the nozzle plate.

32. The ink ejecting device according to claim 28, wherein the ink supply manifold comprises, for each of the plurality of different types of ink, one support port connected to at least one of the plurality of ink chambers, wherein, for each of the ink chambers, the length of the ink chamber along a direction of flow of the ink is determined by a size of the supply port connected to the ink chamber.

* * * * *